US005085184A

United States Patent [19]

Yamada et al.

[11] Patent Number: 5,085,184

[45] Date of Patent: Feb. 4, 1992

[54] DEVICE FOR REDUCING STARTING LOAD ON INTERNAL COMBUSTION ENGINE

[75] Inventors: Yoshikazu Yamada; Hiroyuki Nakano, both of Saitama, Japan

[73] Assignee: Honda Giken Kogyo Kabushiki Kaisha, Tokyo, Japan

[21] Appl. No.: 581,775

[22] Filed: Sep. 13, 1990

[30] Foreign Application Priority Data

Sep. 20, 1989 [JP] Japan ..... 1-244430

[51] Int. Cl.[5] ..... F01L 13/08

[52] U.S. Cl. ..... 123/182.1; 123/90.31; 123/90.6

[58] Field of Search ..... 123/182, 90.16, 90.6, 123/90.31

[56] References Cited

U.S. PATENT DOCUMENTS 3,362,390 1/1968 Esty ..... 123/182

3,381,676 5/1968 Campen ..... 123/182

FOREIGN PATENT DOCUMENTS 53-20593 5/1978 Japan .

63-2565 1/1988 Japan .

*Primary Examiner*—Andrew M. Dolinar

*Attorney, Agent, or Firm*—Dickstein, Shapiro & Morin

[57] ABSTRACT

A device for reducing a load which is imposed on an internal combustion engine when the engine is started, the internal combustion engine having an intake or exhaust valve tappet, which includes a rotatable camshaft having a cam for sliding contact with the intake or exhaust valve tappet, a wheel fixed coaxially to the camshaft, the wheel having a support shaft integrally formed on a side thereof and extending parallel to the axis of the camshaft, a tappet lifting member rotatably supported on the wheel, the tappet lifting member having a cam movable into and out of a base circle of the cam of the camshaft, a weight swingable about the support shaft, the weight having a distal end pivotally coupled to the tappet lifting member and a proximal end rotatably supported on the support shaft, and an urging mechanism, fixedly supported on the support shaft, for urging the weight toward the camshaft to move the cam of the tappet lifting member out of the base circle to press the intake or exhaust valve tappet.

7 Claims, 2 Drawing Sheets

DEVICE FOR REDUCING STARTING LOAD ON INTERNAL COMBUSTION ENGINE

BACKGROUND OF THE INVENTION

1. Field of the Invention

The present invention relates to a device for reducing the load imposed on an internal combustion engine when it is started, and more particularly to a device for reducing the starting load on an internal combustion engine by automatically opening an intake valve or an exhaust valve thereof slightly to lower a compressive pressure in the combustion chamber, thereby reducing the starting load on the engine, the device being operable to automatically cancel the action to lower the compression in the combustion chamber when the engine operates normally.

2. Prior Art

One known device for reducing the starting load on an internal combustion engine is disclosed in Japanese Utility Model Publication No. 63(1988)-2565, for example. The disclosed device includes a camshaft which has a cam for pushing a valve tappet in sliding contact therewith, and a tappet pusher lever angularly movably mounted on the camshaft. A weight which partly engages the tappet pusher lever is swingably mounted on a side of a gear wheel which is coaxially mounted on the camshaft. The weight is normally urged toward the camshaft by a coil spring which has one end coupled to a pin fixed to the side of the gear wheel. When the internal combustion engine rotates at a low speed, the tappet pusher lever engaging the weight is caused to project out of the base circle of the cam under the bias of the coil spring, and pushes the tappet upwardly, thereby automatically opening an intake or exhaust valve slightly. Therefore, the compressive pressure in the combustion chamber is lowered to reduce the load on the engine when it is started. When the rotational speed of the engine reaches a normal speed, the weight is subjected to a centrifugal force which counteracts the bias of the coil spring, and therefore swings outwardly away from the camshaft. The tappet pusher lever, which is engaged by the weight, is also angularly moved into the base circle of the cam, whereupon the automatic opening of the intake or exhaust valve in the low-speed rotation of the engine is canceled.

Some recent internal combustion engines include camshafts molded of synthetic resin for reduced weight. If the known device for reducing the starting load on an internal combustion engine is incorporated in such an internal combustion engine with a camshaft molded of synthetic resin, the molded camshaft and the gear wheel are drilled or pins are mounted on them, with the weight and other components being supported by the drilled holes or pins.

Since it is necessary to drill the molded camshaft or fix pins to the molded camshaft for the attachment of the weight and other components, the camshaft is reduced in mechanical strength, and it is laborious and time-consuming to install the camshaft in place.

SUMMARY OF THE INVENTION

In view of the aforesaid problems of the conventional device, it is an object of the present invention to provide a device for reducing the starting load on an internal combustion engine, which device includes a camshaft that is arranged to minimize additional machining such as drilling which would otherwise reduce the mechanical strength of the camshaft, and which allows various components to be installed easily on the camshaft.

According to the present invention, there is provided a device for reducing a load which is imposed on an internal combustion engine when the engine is started, the internal combustion engine having an intake or exhaust valve tappet, the device comprising a rotatable camshaft having a cam for sliding contact with the intake or exhaust valve tappet, a wheel fixed coaxially to the camshaft, the wheel having a support shaft integrally formed on a side thereof and extending parallel to the axis of the camshaft, a tappet lifting member rotatably supported on the wheel, the tappet lifting member having a cam movable into and out of a base circle of the cam of the camshaft, a weight swingable about the support shaft, the weight having a distal end pivotally coupled to the tappet lifting member and a proximal end rotatably supported on the support shaft, and an urging means, fixedly supported on the support shaft, for urging the weight toward the camshaft to move the cam of the tappet lifting member out of the base circle to press the intake or exhaust valve tappet.

The above and further objects, details and advantages of the present invention will become apparent from the following detailed description of a preferred embodiment thereof, when read in conjunction with the accompanying drawings.

DETAILED DESCRIPTION OF THE PREFERRED EMBODIMENT

Figure 1:
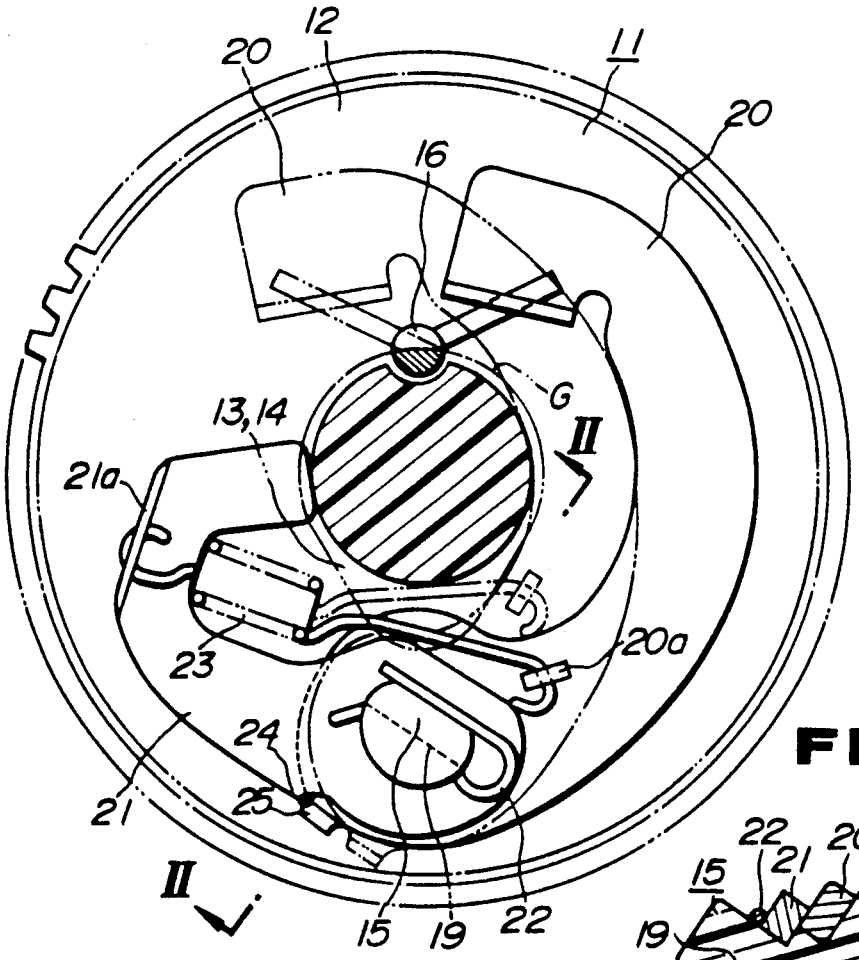
FIG. 1 is a side elevational view of a device for reducing the starting load on an internal combustion engine according to a preferred embodiment of the present invention.

FIG. 1 shows in side elevation a device for reducing the starting load on an internal combustion engine according to a preferred embodiment of the present invention.

Figure 3:
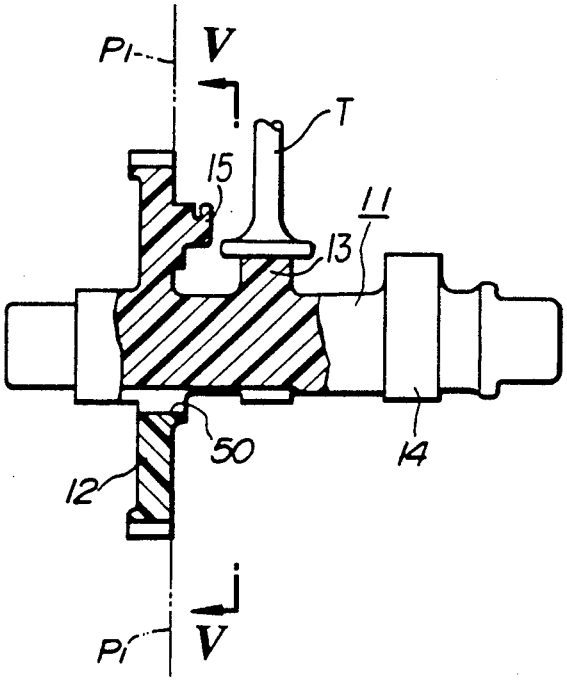
FIG. 3 is a front elevational view, partly in cross section, of a camshaft in the device shown in FIG. 1.
Figure 4:
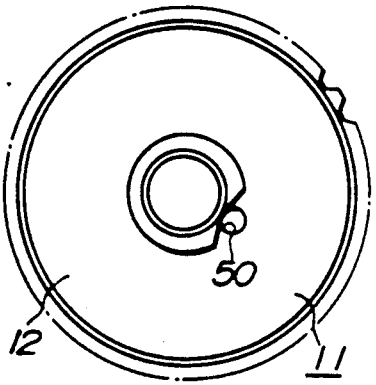
FIG. 4 is a lefthand side elevational view of the camshaft shown in FIG. 3.

As shown in FIG. 1, a camshaft 11 is rotatably supported in the cylinder head of an internal combustion engine (not shown). The camshaft 11 is of an integrally molded unitary structure of synthetic resin and includes a cam gear (wheel) 12 and two cams 13, 14, as shown in FIG. 3. The cam gear 12 of the camshaft 11 is operatively coupled to a crankshaft (not shown) of the engine through a gear train. Therefore, the camshaft 11 is rotatable in timed relation to the crankshaft. Tappet "T" coupled to valves of the engine are held in sliding contact with the cam surfaces of the cams 13. 14.

A support shaft 15 (FIG. 3) integrally projects axially from an axial side of the cam gear 12. As shown in FIG. 1, a release pin (tappet pusher member) 16 is rotatably inserted in a hole 50 (FIG. 3) which is defined axially through the cam gear 12 and partly in an outer circumferential surface of the shank of the camshaft 11.

Figure 2:
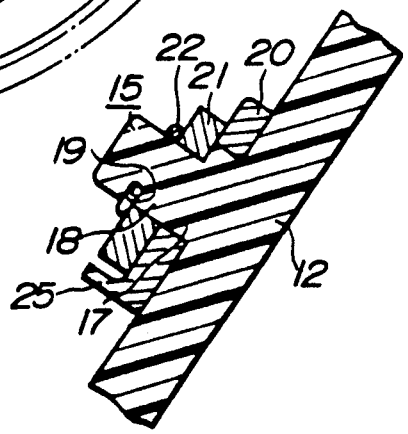
FIG. 2 is an enlarged cross-sectional view taken along line II—II of FIG. 1.

As shown in FIG. 2, the support shaft 15 has a first support 17, a second support 18, and a clip groove 19 which are arranged successively axially from the side of the cam gear 12 toward the tip end of the support shaft 15. The first support 17 has a substantially circular cross section, and a weight 20 has a proximal end rotatably fitted over the first support 17. The second support 18 has a substantially semicircular cross section and is partly stepped from the first support 17, and a stay 21 has a proximal end fitted nonrotatably over the second support 18. The clip groove 19 extends parallel to the chord of the second support 18, and a clip 22 has an end portion which is fitted in the clip groove 19. The second support 18 has an axis with respect to which the second support 18 is symmetric in shape, the axis extending perpendicularly to the clip groove 19. The clip 22 prevents the weight 20 and the stay 21 from being removed from the support shaft 15.

As shown in FIG. 1, the weight 20 is in the form of a flat arcuate plate whose proximal end is rotatably supported on the support shaft 15 and opposite distal end is pivotally coupled to the release pin 16. As a whole, the weight 20 is angularly movable about the support shaft 15.

The release pin 16 comprises a shaft having a cam of a substantially half-moon-shaped cross section, and a lever joined to and projecting radially from the shaft in a substantially L-shaped fashion. The cam of the release pin 16 can be turned when the lever thereof is turned with angular movement of the weight 20.

The stay 21 comprises a flat metal plate having an inverted substantially J-shaped configuration. The proximal end of the stay 21 is fixedly fitted over the second support 18 of the support shaft 15 and is positioned between the clip 22 and the weight 20. The stay 21 has a distal end held against a peripheral surface of the shank of the camshaft 11. The stay 21 includes a retainer 21*a* on a curved outer surface thereof, with a spring 23 acting under tension between the retainer 21*a* and an engaging member 20*a* on the weight 20 near its pivoted proximal end. The weight 20 is normally urged to move toward the axis of the camshaft 11 under the bias of the spring 23. A stopper recess 24 is defined in the proximal end portion of the stay 21, and has a bottom engageable with a finger 25 on the pivoted proximal end of the weight 20. The stopper recess 24, when engaging the finger 25, limits the outward swinging movement of the weight 20 under centrifugal forces, and hence defines a maximum limit position for such outward swinging movement of the weight 20. The stay 21 and the spring 23 serve as urging means for urging the weight 20 toward the axis of the camshaft 11.

When the engine is started, the weight 20 is held in the imaginary-line position shown in FIG. 1 under the resilient force of the spring 23. When the engine rotates steadily or normally after it has been started, since the weight 20 is subjected to centrifugal forces, the weight 20 is forced to swing about the support shaft 15 outwardly into the solid-line position in FIG. 1. Upon starting of the engine, the cam of the release pin 16 projects out of a base circle G of the cam 13 of the camshaft 11 and pushes the tappet, thereby reducing the load on the engine at the time it is started. Upon steady or normal rotation of the engine, as the weight 20 swings outwardly, the cam of the release pin 16 rotates and is retracted into the base circle G. Therefore, the cam of the release pin 16 no longer pushes the tappet, but only the cam 13 slidingly pushes the tappet, so that the engine operates normally.

In the manufacture of the camshaft 11, the camshaft 11 and the cam gear 12 with the axially projecting support shaft 15 can integrally be molded together as a unitary structure.

Figure 5:
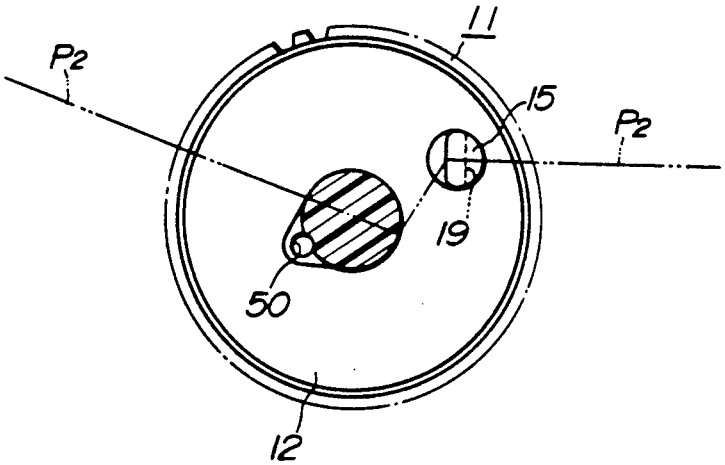
FIG. 5 is a cross-sectional view taken along line V—V of FIG. 3.

The camshaft 11 is molded with a mold assembly which has parting lines P1, P2 shown in FIG. 3 and 5, with the parting line P2 extending perpendicularly to the clip groove 19. Therefore, the cam gear 12, the cams 13, 14, and the support shaft 15 can be molded using a single mold assembly, so that the camshaft 11 can easily be molded.

To assemble the device, the weight 20 and the stay 21 are successively mounted on the support shaft 15, and then retained on the support shaft 15 by the clip 22. Thereafter, the spring 23 is installed on and kept under tension between the stay 21 and the weight 20, whereupon the device is completed. Consequently, it is not necessary to additionally machine, i.e., drill, the camshaft 11, for the installation of the weight 20, the stay 21, and the spring 23. The camshaft 11 and the cam gear 12 thus retain their mechanical strength. The weight 20, the stay 21, and the spring 23 are also installed with utmost ease. The stay 21 functions as a washer between the weight 20 and the clip 22, so that the weight 20 is allowed to swing smoothly without any additional component required for such smooth swinging movement of the weight 20.

With the device for reducing the starting load on an internal combustion engine according to the present invention, as described above, the weight and other components can be installed on the camshaft which is molded of synthetic resin, without the need for any additional machining of the camshaft. Accordingly, the camshaft is prevented from being reduced in mechanical strength, and the various components can easily and quickly be installed on the camshaft.

Although there has been described what is at present considered to be the preferred embodiment of the present invention, it will be understood that the invention may be embodied in other specific forms without departing from the essential characteristics thereof. The present embodiment is therefore to be considered in all aspects as illustrative, and not restrictive. The scope of the invention is indicated by the appended claims rather than by the foregoing description.

We claim:

1. A device for reducing a load which is imposed on an internal combustion engine when the engine is started, the internal combustion engine having an intake or exhaust valve tappet, said device comprising:

a rotatable camshaft having a cam for sliding contact with the intake or exhaust valve tappet;

a wheel fixed coaxially to said camshaft, said wheel having a support shaft integrally formed on a side thereof and extending parallel to the axis of said camshaft;

a tappet lifting member rotatably supported on said wheel, said tappet lifting member having a cam movable into and out of a base circle of said cam of the camshaft;

a weight swingable about said support shaft, said weight having a distal end pivotally coupled to said tappet lifting member and a proximal end rotatably supported on said support shaft; and urging means, fixedly supported on said support shaft, for urging said weight toward said camshaft to move said cam of the tappet lifting member out of said base circle to press the intake or exhaust valve tappet and for defining a maximum position for outward swinging movement of said weight about said support shaft under centrifugal forces in response to rotation of said camshaft, which are produced against the urging of said urging means on said weight.

2. A device according to claim 1, wherein said urging means comprises a stay having a distal end held against an outer peripheral surface of said camshaft and a proximal end fixedly fitted over said support shaft, and a spring, extending from said stay between the distal and proximal ends thereof toward said weight, for urging said weight toward said camshaft.

3. A device according to claim 1, wherein said wheel has a hole defined therein, said tappet lifting member comprising a release pin having said cam, said release pin being rotatably inserted through said hole of the wheel, and a lever projecting radially from said release pin, said distal end of said weight being pivotally coupled to said lever to allow said lever to swing with swinging movement of said weight for permitting said cam of the release pin to move into and out of said base circle of the cam of said camshaft.

4. A device according to claim 2, further including a stopper defined on the proximal end of said stay and engageable with the proximal end of said weight, for defining said maximum position for outward swinging movement of said weight about said support shaft.

5. A device according to claim 1, wherein said wheel having said support shaft and said camshaft are of an integral unitary structure molded of resin.

6. A device for reducing a load which is imposed on an internal combustion engine when the engine is started, the internal combustion engine having an intake or exhaust valve tappet, said device comprising:

a rotatable camshaft having a cam for sliding contact with the intake or exhaust valve tappet;

a wheel fixed coaxially to said camshaft, said wheel having a support shaft integrally formed on a side thereof and extending parallel to the axis of said camshaft;

a weight rotatably supported on said support shaft for swinging movement about the support shaft;

an auxiliary camshaft rotatably supported on said wheel and engaging said weight for rotation with swinging movement of said weight to press the intake or exhaust valve tappet independently of said camshaft; and urging means, fixedly supported on said support shaft, for normally urging said weight toward the axis of said camshaft and for defining a maximum position for outward swinging movement of said weight under centrifugal forces which are produced against the urging of said weight in response to rotation of said camshaft.

7. A device according to claim 6, wherein said support shaft includes a first support having a circular cross section over which said weight is rotatably fitted, and a second support having a substantially semicircular cross section, said first and second supports being successively arranged from the side of said wheel, said urging means comprising at least a stay nonrotatably fitted over said second support and partly engageable with said weight upon maximum outward swinging movement of said weight, and a spring extending between said weight and said stay for urging said weight toward the axis of said support shaft.

* * * * *